US009431198B2

(12) United States Patent
Reuber et al.

(10) Patent No.: US 9,431,198 B2
(45) Date of Patent: Aug. 30, 2016

(54) CIRCUIT-BREAKER POLE PART WITH A HEAT TRANSFER SHIELD

(71) Applicant: ABB Technology AG, Zurich (CH)

(72) Inventors: Christian Reuber, Willich (DE); Dietmar Gentsch, Ratingen (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 14/588,628

(22) Filed: Jan. 2, 2015

(65) Prior Publication Data

US 2015/0114932 A1 Apr. 30, 2015

Related U.S. Application Data

(63) Continuation of application No. PCT/EP2013/001927, filed on Jul. 2, 2013.

(30) Foreign Application Priority Data

Jul. 2, 2012 (EP) ..... 12004904

(51) Int. Cl.
*H01H 9/52* (2006.01)
*H01H 33/662* (2006.01)
(Continued)

(52) U.S. Cl.
CPC ... *H01H 33/66261* (2013.01); *H01H 33/6606* (2013.01); *H01H 1/5833* (2013.01);
(Continued)

(58) Field of Classification Search
CPC ..... H01H 2033/66276; H01H 33/66261; H01H 9/52
See application file for complete search history.

(56) References Cited

U.S. PATENT DOCUMENTS 4,403,124 A * 9/1983 Perkins ..... H01H 33/668 200/50.23
4,618,749 A * 10/1986 Bohme ..... H01H 33/66207 218/134

(Continued)

FOREIGN PATENT DOCUMENTS

DE 41 42 971 A1 7/1993
EP 0 176 665 A2 4/1986

(Continued)

OTHER PUBLICATIONS

International Search Report (PCT/ISA/210) mailed on Oct. 14, 2013, by the European Patent Office as the International Searching Authority for International Application No. PCT/EP2013/001927.

(Continued)

*Primary Examiner* — Truc Nguyen
(74) *Attorney, Agent, or Firm* — Taft Stettinius & Hollister LLP

(57) ABSTRACT

A pole part of a circuit-breaker arrangement having an insulation housing for accommodating a vacuum interrupter insert containing a pair of corresponding electrical switching contacts, wherein a fixed upper electrical contact is connected to an upper electrical terminal molded in the insulation housing and a movable lower electrical contact is connected to a lower electrical terminal of the insulation housing via an electrical conductor which is operated by an adjacent pushrod. The lower electrical terminal is connected to a ring shaped heat transfer shield arranged along the inner wall or at least partly inside the wall of the insulation housing surrounding the pushrod and/or the distal end of the movable lower electrical contact.

10 Claims, 3 Drawing Sheets

(51) Int. Cl.

| | |
|---|---|
| ***H01H 33/66*** | (2006.01) |
| *H01H 1/58* | (2006.01) |
| *H01H 33/666* | (2006.01) |

(52) U.S. Cl.

CPC ..... *H01H2033/6613* (2013.01); *H01H 2033/6623* (2013.01); *H01H 2033/6665* (2013.01); *H01H 2033/66276* (2013.01)

(56) References Cited

U.S. PATENT DOCUMENTS 5,512,724 A * 4/1996 Binder ..... H01H 33/666 218/139
2003/0150841 A1* 8/2003 Magnussen ..... H02P 6/00 218/118
2010/0181291 A1 7/2010 Gentsch
2011/0000886 A1* 1/2011 Isoya ..... H01H 33/6661 218/139
2011/0120976 A1 5/2011 Gentsch

FOREIGN PATENT DOCUMENTS

EP 2 139 016 A1 12/2009
WO WO 2009/043361 A1 4/2009
WO WO 2012/007172 A1 1/2012

OTHER PUBLICATIONS

Written Opinion (PCT/ISA/237) mailed on Oct. 14, 2013, by the European Patent Office as the International Searching Authority for International Application No. PCT/EP2013/001927.
Search Report mailed on Nov. 28, 2012, by the European Patent Office for Application No. 12004904.4.

* cited by examiner

CIRCUIT-BREAKER POLE PART WITH A HEAT TRANSFER SHIELD

RELATED APPLICATION

This application claims priority as a continuation application under 35 U.S.C. §120 to PCT/EP2013/001927, which was filed as an International Application on Jul. 3, 2013 designating the U.S., and which claims priority to European Application 12004904.4 filed in Europe on Jul. 2, 2012. The entire contents of these applications are hereby incorporated by reference in their entireties.

FIELD

The present disclosure relates to a pole part of a circuit breaker arrangement, such as an arrangement having an insulation housing for accommodating a vacuum interrupter insert containing a pair of corresponding electrical switching contacts, wherein a fixed upper electrical contact is connected to an upper electrical terminal molded in the insulation housing and a movable lower electrical contact is connected to a lower electrical terminal of the insulation housing via an electrical conductor which is operated by an adjacent pushrod.

BACKGROUND INFORMATION

A circuitbreaker pole part can be integrated in a medium-voltage to high-voltage circuitbreaker arrangement. For example, medium-voltage circuitbreakers are rated between 1 and 72 kV of a high current level. These specific breakers interrupt the current by creating and extinguishing the arc in a vacuum container. Inside the vacuum container a pair of corresponding electrical switching contacts is accommodated. Modern vacuum circuitbreakers can have a longer life expectancy than former air circuitbreakers. Although, vacuum circuitbreakers can replace aircircuit breakers, the present disclosure is not only applicable to vacuum circuitbreakers but also for air circuitbreakers or modern SF6 circuitbreakers having a chamber filled with sulfurhexafluoride gas instead of vacuum. For actuating a circuitbreaker, a drive with a high force is used which moves one of the electrical contacts of a vacuum interrupter insert for a purpose of electrical power interruption. Therefore, a mechanical connection between a drive and an axially movable electrical contact inside the vacuum interrupter insert is provided.

The document WO 2012/007172 A1 discloses a circuit breaker pole part having an external insulating sleeve made of a solid synthetic material for supporting and housing a vacuum interrupter insert for electrical switching a medium-voltage circuit, wherein an adhesive material layer is applied at least on the lateral area of the interrupter insert. The coated interrupter insert is embedded by molding with the solid synthetic material (e.g., epoxy material, thermal plastic material, silicon rubber material). Thus, an intermediate layer with a mechanical compensating function and an adhesive property function for embedding the vacuum interrupter is provided. The special adhesive material layer according to this solution could be used for a temperature over at least 115° C. and could withstand −40° C. Due to ohmic losses in the pole parts and due to the limited heat transfer from the pole part to the environment, the temperature can increase during operation. Depending on the material used, certain maximum temperatures—which are defined in the relevant standards—are not to be exceeded.

One of the most important regions of switching poles is the transition from the fixed parts to the movable parts.

Two known ways to increase a related nominal current of a pole part without increasing temperature are as follows. Firstly, the electrical resistance of the electrical contacts inside the vacuum interrupter insert could be reduced by increasing the cross-section of the electrical contacts which can be made of a copper material. However, this solution will increase the material effort. Secondly, the heat transfer can be improved since there can be regions on a pole part where the allowed temperatures are fully exploited while in other regions there is still a margin.

The document DE 41 42 971 A1 discloses a pole part for a medium-voltage circuitbreaker having an insulation housing with an upper electrical terminal and a lower electrical terminal for electrically connecting the pole part with a medium-voltage circuit. A vacuum interrupter insert is integrated in the insulation housing and its fixed upper electrical contact is electrically connected to the upper electrical terminal; its movable lower electrical contact is electrically connected to the lower electrical terminal.

Inside the vacuum interrupter insert a ring-shaped shield is integrated surrounding the area of both electrical switching contacts. The shield can be formed of metallic or ceramic material. The shield is used as a thermal protection shield in order to avoid critical temperatures in the area of the electrical switching contacts only.

SUMMARY

A pole part is disclosed of a circuit-breaker arrangement comprising: an insulation housing for accommodating a vacuum interrupter insert containing a pair of corresponding electrical switching contacts, wherein a fixed upper electrical contact is connected to an upper electrical terminal molded in the insulation housing and a movable lower electrical contact is connected to a lower electrical terminal of the insulation housing via an electrical conductor for operation by an adjacent pushrod; and a ring shaped heat transfer shield connected with the lower electrical contact and arranged along an inner wall or at least partly inside a wall of the insulation housing surrounding the pushrod and/or a distal end of the movable lower electrical contact.

BRIEF DESCRIPTION OF THE DRAWINGS

The foregoing and other aspects of the present disclosure will become apparent following the detailed description of the invention when considered in conjunction with the enclosed drawings, wherein.

All drawings are schematic, wherein like elements re representative by like numbers.

DETAILED DESCRIPTION

Figure 1:
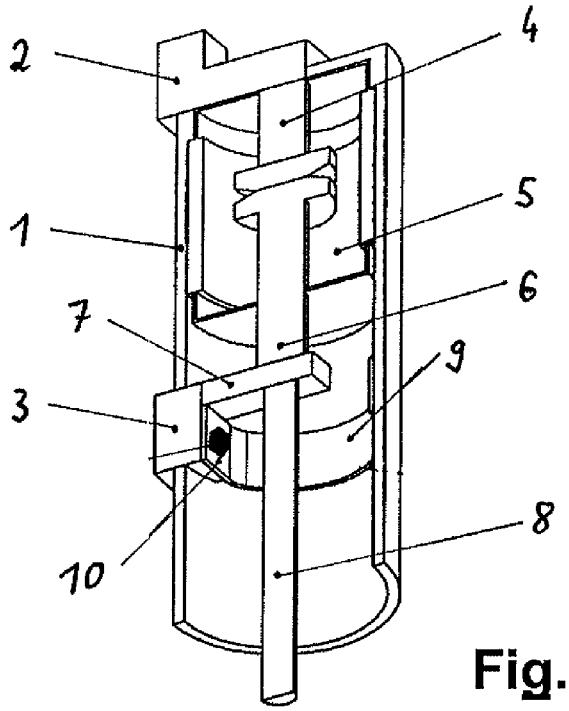
FIG. 1 shows a side view of a medium-voltage circuitbreaker pole part according to a first exemplary embodiment.

Heat transfer means inside a pole part of a circuit breaker arrangement are disclosed for transferring heat from a relatively hot region of a pole part to one or more regions that can still bear an additional temperature increase.

According to exemplary embodiments, a lower electrical terminal of the pole part is connected to a ring-shaped heat transfer shield arranged along the inner wall or at least partly inside the wall of the insulation housing surrounding the push-rod and/or the distal end of the movable lower electrical contact.

Due to a special arrangement of the heat transfer shield in the region of a lower electrical terminal, a significant cooling effect can be achieved so that a nominal rated current of the pole part can be increased. If the heat transfer shield is molded inside the insulation housing it can be partly or fully surrounded by the insulating material. Molding the heat transfer shield inside the insulation housing can result in an optimal heat transfer from the heat transfer shield to the insulation housing. In order to ease the manufacturing process of the pole part it is possible to form the heat transfer shield from a thermally conducting plastic material inside the wall of the insulating housing in a two-step injection molding process.

In embodiments where the heat transfer shield is assembled on the surface of the inner wall of the insulation housing it can be attached to the insulation housing and/or the lower electrical terminal by at least one screw or rivet element. In order to achieve a relatively better thermic contact to the insulation housing the heat transfer shield can be attached to its inner wall and/or the lower electrical terminal by pressing against the inner wall of the insulation housing. The pressing force of the transfer shield can, for example, be provided by a tension clamp shape of the heat transfer shield itself or a dedicated spring element. The mechanical tension in the heat transfer shield keeps it pressed and placed during the lifetime of the pole part.

It is further proposed to press the heat transfer shield onto the inner wall of the insulation housing during the curing of the glue. Appropriate pressure can be achieved, for example, by using a jig or a wedge or an air cushion that will be inflated to generate the pressure, or by a ring of rubber that follows the shape of the heat transfer shield and that can be mechanically pressed axially, so that the rubber extends radial and presses the heat transfer shield against the insulation housing during the curing process of the glue.

The heat transfer shield according to exemplary embodiments can include (e.g., consist of) a copper or aluminum material. In order to have a good thermal conductivity, the heat transfer shield can be mounted in close contact both to the lower electrical terminal and to the insulation housing.

In order to further increase the thermal conductivity it can be recommended to arrange the heat transfer shield inside the insulation housing in a manner that it axially extends between the lower electrical terminal and the bottom side of the vacuum interrupter insert. If the heat transfer shield is large enough to touch the vacuum interrupter insert the following exemplary advantages can be realized. Firstly, the surface of the heat transfer shield is relatively large, which causes an alleviated heat transfer into the insulation housing. Secondly, since the housing of the vacuum interrupter insert can be made of ceramic materials, the vacuum interrupter insert has a better heat conductivity than the insulation housing which can be made of plastic materials. In the area of the vacuum interrupter insert, the temperature is relatively low. Thus, the heat transfer from the heat transfer shield to the insulation housing is even more supported. If a relatively large heat transfer shield is used, the mechanical properties of the heat transfer shield can be exploited to increase the overall mechanical stability of the pole part (e.g., to increase the ability of the pole part to withstand the forces of peak currents in short circuit conditions). This can be especially valid if there is a good, laminar mechanical connection of heat transfer shield and insulation housing (e.g., due to gluing or molding).

It is also possible, that the axially extended heat transfer shield completely surrounds the lower end of the vacuum interrupter insert for an optimized heat transfer of an exemplary embodiment. This can involve a dedicated design of the heat transfer shield considering the current design of the pole part. Design options are in the regions of the heat transfer shield which are bent during or after insertion of the heat transfer shield into the pole part, or a design of the heat transfer shield that includes more than one piece.

Exemplary embodiments are not limited to pole parts that use one or more flexible electrical conductors for the electrical conduction between the lower electrical terminal and the movable lower electrical contact. It is also possible to use sliding contacts between both electrical parts in order to establish the electrical connection. In this case the heat transfer shield can be arranged between the sliding contact arrangement and the bottom side of the vacuum interrupter insert. A sliding contact arrangement can include spiral contacts or a plurality of contact pieces that are held under pressure between the fixed and the movable electrical part.

Depending on assembly preferences, the heat transfer shield of exemplary embodiments can be generally shaped in a closed or in an opened ring form. The thickness of the heat transfer shield can be adapted to the highest amount of transferred heat. In order to increase the heat transfer ability it is proposed to increase the other surface of the heat transfer shield by a rib structure or a bended or embossed structure of the surface or the like. For example, ribs can be located at the inner surface and/or the outer surface of the ring-shaped heat transfer shield. If the ribs or another structure are located at the outer surface of the ring-shaped heat transfer shield, the structure would extend into the material of the insulation housing.

In specific pole parts, separate inserts are being used in order to increase the creepage distance from the lower electrical terminal to the grounded base where the pole part is mounted. In order to reduce the number of single parts that are to be mounted, it is proposed to combine such a separate insert with the heat transfer shield in one piece, such as by injection molding. If the heat transfer shield consists of a plastic material, it can be manufactured in a two-step molding process, such as in a two-step injection molding process together with the insert. If the heat transfer shield consists of a metallic material, it can be a part that is inserted in the mold prior to the molding of the insert.

An exemplary medium-voltage circuit-breaker as shown in FIG. 1 principally includes an insulation housing 1 with an embedded upper electrical terminal 2 and a lower electrical terminal 3 forming an electrical switch for a medium-voltage circuit.

Therefore, the upper electrical terminal 2 is connected to a corresponding fixed upper electrical contact 4 which is stationary mounted at a vacuum interrupter insert 5. The corresponding lower electrical contact 6 is movable mounted in relation to the vacuum interrupter insert 5.

The lower electrical terminal 3 is connected to the corresponding movable lower electrical contact 6 via an electrical conductor 7. The movable lower electrical contact 6 is movable between a closed and an opened switching position by a pushrod 8. The electrical conductor 7 of the present exemplary embodiment includes (e.g., consists of) a flexible copper fiber material.

The lower electrical terminal 3 is connected to a ring-shaped heat transfer shield 9 which is arranged along the inner wall of the insulation housing 1 surrounding the pushrod 8. The ring-shaped heat transfer shield includes (e.g., consists of) copper material and transfers the high temperature in the region of the lower electrical terminal 3 into the material of the insulating housing 1 for cooling purpose.

The heat transfer shield 9 can for example, be attached to the insulating housing 1 by gluing, and to the lower electrical terminal 3 by at least one screw element 10.

Figure 2A:
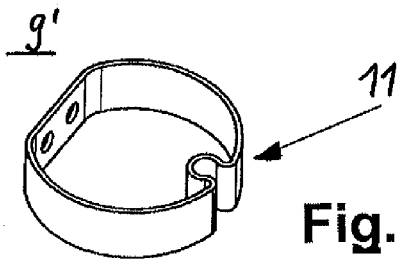
FIG. 2*a*-2*d* is a perspective view of several exemplary embodiments of ring-shaped heat transfer shields.

According to FIG. 2*a* another exemplary embodiment of the heat transfer shield 9' is shaped as a clamp in order to press the heat transfer shield 9' against the inner wall of the insulating housing 1. For generating the pressing force, the ring-shaped heat transfer shield 9' can be provided with at tension clamp section 11.

Figure 2C:
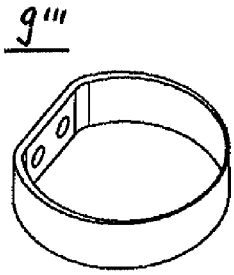
Figure 2B:
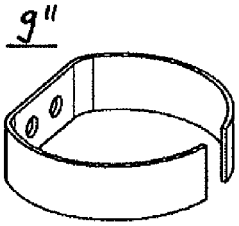

Another exemplary embodiment of the heat transfer shield 9" according to FIG. 2*b* is shaped as an open ring. The pressing force is provided by both wings of the heat transfer shield 9".

In contrast, according to FIG. 2*c* another exemplary embodiment of the heat transfer shield 9'" is shaped as a closed ring. Since no pressing force can be generated by the closed ring shape, the heat transfer shield 9'" is attached to the insulating housing 1 by screws, rivet elements or by gluing or welding or other suitable attachment. Furthermore, it is possible to mold the heat transfer shield 9'" inside the wall of the insulation housing 1.

Figure 2D:
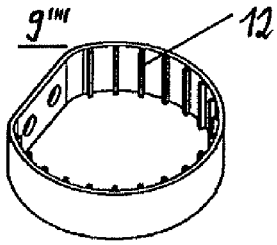

FIG. 2*d* shows another exemplary embodiment of a heat transfer shield 9"". The inner surface of the heat transfer shield 9"" is provided with a rib structure 12 in order to increase the surface of the heat transfer shield 9"" for improving the transition of heat. The increased surface can be due to a bended or embossed structure of the surface or due to separate ribs as shown.

Figure 3A:
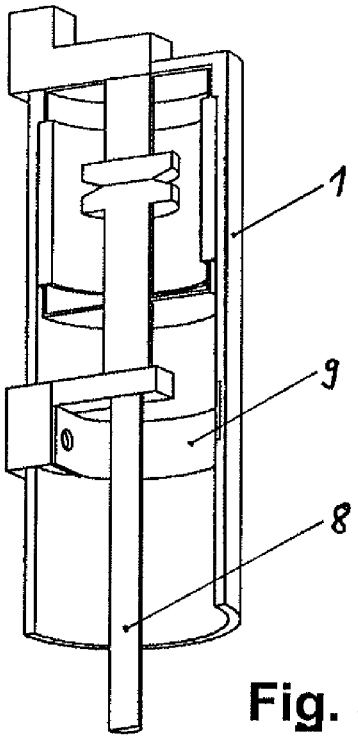
FIG. 3*a*-3*b* is a side view of second and third exemplary embodiments of the pole part.
Figure 3B:
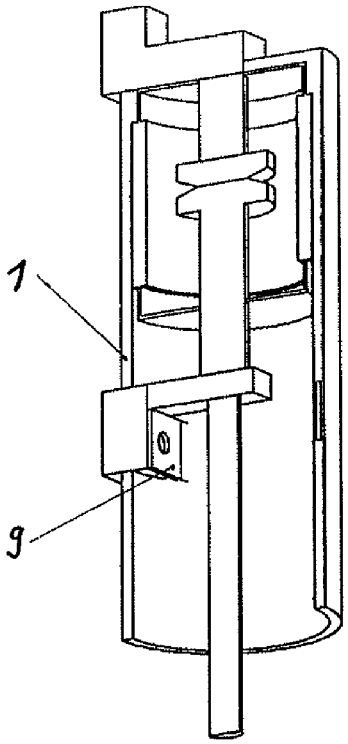

According to the exemplary embodiment of FIG. 3*a*, the heat transfer shield 9 is arranged along the inner wall of the insulation housing 1 surrounding the pushrod 8. In contrast, according to FIG. 3*b* the ring-shaped heat transfer shield 9 is partly accommodated inside the wall of the insulation housing 1 and also surrounds the pushrod 8. The integration of the heat transfer shield 9 into the wall of the insulation housing 1 is realized by molding techniques.

Figure 4:
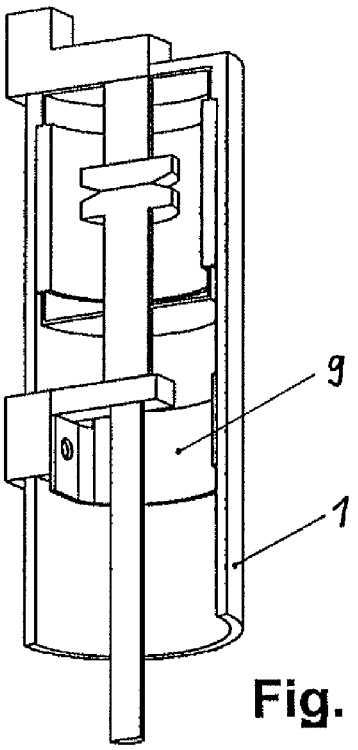
FIG. 4 is a side view of a fourth exemplary embodiment of the pole part.
Figure 5:
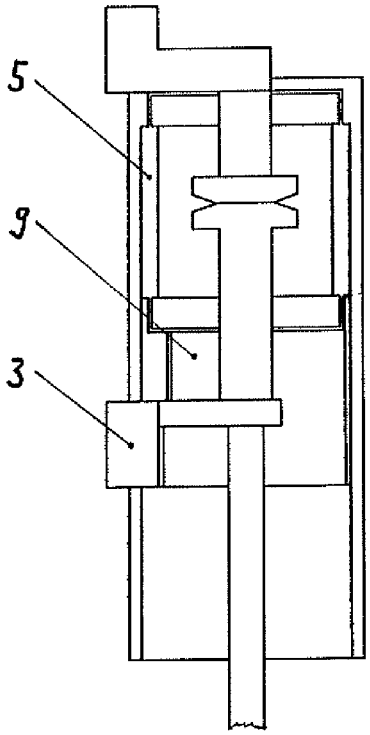
FIG. 5 is a side view of a fifth exemplary embodiment of the pole part.

According to FIG. 4, the heat transfer shield 9 is axially extended in the direction of the open end of the insulation housing 1. According to another exemplary embodiment of FIG. 5, the heat transfer shield 9 is also axially extended from the lower electrical terminal 3 but in the direction of the vacuum interrupter insert 5. The heat transfer shield 9 itself can also made of thermoplastic material, for example, a kind of material with a relatively low thermal resistance.

An exemplary advantage is that this part can be manufactured at comparable low costs, and that it even can be created together with the insulating housing 1 in a 2-step injection moulding process, avoiding the need of assembling separate parts. A disadvantage of generally higher thermal resistance of thermoplastic materials compared to metals can be compensated by an increased surface of the heat transfer shield 8, as shown in the following figures.

Figure 6:
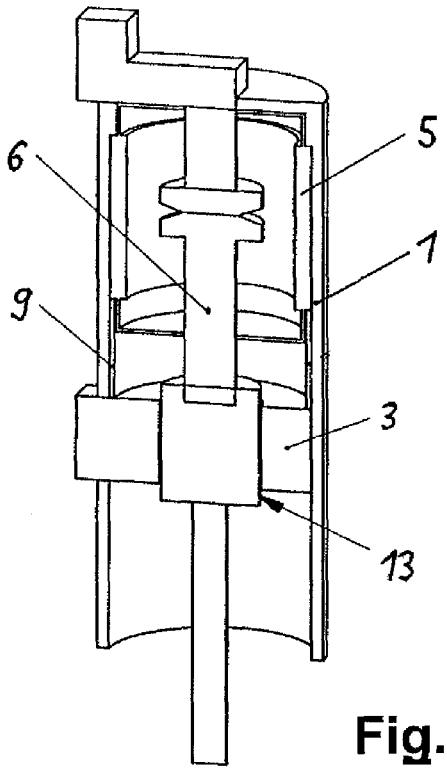
FIG. 6 is a side view of a sixth exemplary embodiment of the pole part.

FIG. 6 shows another exemplary embodiment of a pole part, wherein the movable lower electrical contact 6 is electrically connected to the lower electrical terminal 3 via a sliding contact arrangement 13. The heat transfer shield 9 is axially arranged between the sliding contact arrangement 13 and the bottom side of the vacuum interrupter insert 5.

Figure 7:
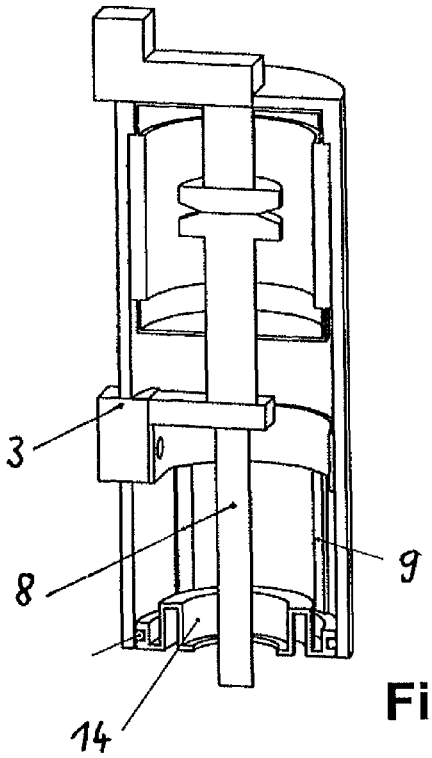
FIG. 7 is a side view of a seventh exemplary embodiment of the pole part.

In a further exemplary embodiment according to FIG. 7 the heat transfer shield 9 is molded on an insert 14 arranged on the open bottom end of the insulation housing 1. The insert can be combined with the heat transfer shield 9 in a one piece part. Thus, the insert 14 for increasing the creepage distance from the lower electrical terminal 3 to the grounded base as well as the adjacent heat transfer shield 9 surrounds the pushrod 8 of the pole part.

The invention is not limited by the exemplary embodiments as described herein which are presented as examples only but can be modified in various ways in the scope of protection defined by the patent claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SIGNS

1 insulation housing
2 upper electrical terminal
3 lower electrical terminal
4 fixed upper electrical contact
5 vacuum interrupter insert
6 movable lower electrical contact
7 electrical conductor
8 pushrod
9 heat transfer shield
10 screw/rivet element
11 clamp section
12 rib structure
13 sliding contact arrangement
14 insert

The invention claimed is:

1. A pole part of a circuit-breaker arrangement comprising:

an insulation housing for accommodating a vacuum interrupter insert containing a pair of corresponding electrical switching contacts, wherein a fixed upper electrical contact is connected to an upper electrical terminal molded in the insulation housing and a movable lower electrical contact is connected to a lower electrical terminal of the insulation housing via an electrical conductor for operation by an adjacent pushrod;

a ring shaped heat transfer shield connected with the lower electrical terminal and arranged along an inner wall or at least partly inside a wall of the insulation housing surrounding the pushrod and/or a distal end of the movable lower electrical contact, wherein the heat transfer shield is attached to the insulation housing and/or the lower electrical terminal by a press fit against the inner wall of the insulation housing; and a tension clamp section or a dedicated spring element for providing a pressing force of the heat transfer shield.

2. A pole part according to claim 1, wherein the heat transfer shield axially extends between the lower electrical terminal and a bottom side of the vacuum interrupter insert.

3. A pole part according to claim 1, wherein the heat transfer shield is a thermoplastic material.

4. A pole part according to claim 1, wherein the heat transfer shield is an injection moulded part.

5. A pole part according to claim 1, wherein the movable lower electrical contact is electrically connected to the lower electrical terminal via a sliding contact arrangement and the heat transfer shield is axially arranged between the sliding contact arrangement and a bottom side of the vacuum interrupter insert.

6. A pole part of a circuit-breaker arrangement comprising:

an insulation housing for accommodating a vacuum interrupter insert containing a pair of corresponding electrical switching contacts, wherein a fixed upper electrical contact is connected to an upper electrical terminal molded in the insulation housing and a movable lower electrical contact is connected to a lower electrical terminal of the insulation housing via an electrical conductor for operation by an adjacent pushrod; and a ring shaped heat transfer shield connected with the lower electrical terminal and arranged along an inner wall or at least partly inside a wall of the insulation housing surrounding the pushrod and/or a distal end of the movable lower electrical contact, wherein the ring shaped heat transfer shield comprises:

an increased inner or outer surface provided by a rib structure.

7. A pole part according to claim 6, wherein the heat transfer shield axially extends between the lower electrical terminal and a bottom side of the vacuum interrupter insert.

8. A pole part according to claim 6, wherein the heat transfer shield is attached to the insulation housing and/or the lower electrical terminal by at least one screw or rivet element.

9. A pole part according to claim 6, wherein the heat transfer shield is attached to the insulation housing and/or the lower electrical terminal by glue or a welded connection.

10. A pole part of a circuit-breaker arrangement comprising:

an insulation housing for accommodating a vacuum interrupter insert containing a pair of corresponding electrical switching contacts, wherein a fixed upper electrical contact is connected to an upper electrical terminal molded in the insulation housing and a movable lower electrical contact is connected to a lower electrical terminal of the insulation housing via an electrical conductor for operation by an adjacent pushrod; and a ring shaped heat transfer shield connected with the lower electrical terminal and arranged along an inner wall or at least partly inside a wall of the insulation housing surrounding the pushrod and/or a distal end of the movable lower electrical contact, wherein the heat transfer shield is molded on an insert arranged on an open bottom end of the insulation housing surrounding the pushrod.

* * * * *